United States Patent [19]

Yamane

[11] 4,408,522

[45] Oct. 11, 1983

[54] DEVICE FOR SECURING DIES

[75] Inventor: Yasuhide Yamane, Osaka, Japan

[73] Assignee: Teikoku Chuck Co., Ltd., Yao, Japan

[21] Appl. No.: 319,876

[22] Filed: Nov. 9, 1981

[51] Int. Cl.[3] ..... B30B 15/02

[52] U.S. Cl. ..... 100/295; 72/446; 72/462; 72/481; 83/698; 100/918; 403/374; 403/409

[58] Field of Search ..... 100/295, 918; 403/409, 403/350, 374; 83/698; 72/446, 448, 462, 481

[56] References Cited

U.S. PATENT DOCUMENTS

| | | | |
|---|---|---|---|
| 3,139,676 | 7/1964 | Grover | 100/918 X |
| 3,702,560 | 11/1972 | Weidel | 72/481 |
| 4,274,332 | 6/1981 | Nakamura | 100/918 X |

FOREIGN PATENT DOCUMENTS

| | | | |
|---|---|---|---|
| 2757881 | 10/1978 | Fed. Rep. of Germany | 100/918 |

*Primary Examiner*—Billy J. Wilhite

*Attorney, Agent, or Firm*—Wenderoth, Lind & Ponack

[57] ABSTRACT

A device for securing dies on a die mount is disclosed, which includes a plurality of first and second clamps which are tiltably mounted on a die mount and a camshaft extends through openings in the clamps and serves to secure the dies.

1 Claim, 5 Drawing Figures

DEVICE FOR SECURING DIES

BACKGROUND OF THE INVENTION

The present invention relates to a device for securing a plurality of dies to the die mount on the bed and ram of a press such as a transfer press.

It has been a common practice to secure a large number of dies to the surface of the die mount one by one, which entailed much labor and time.

SUMMARY OF THE INVENTION

It is an object of the present invention to eliminate and solve the above-described disadvantage.

According to the present invention, a plurality of clamps for clamping the dies are arranged in a plurality of rows on the surface of a die mount. When a camshaft extending through the openings provided in the clamps is turned, the dies arranged at both sides of the clamps are securely clamped against the mount by the clamps.

With this object in view and as will become apparent from the following description, the present invention will be more clearly understood in connection with the accompanying drawings.

DETAILED DESCRIPTION OF THE INVENTION

Figure 1:
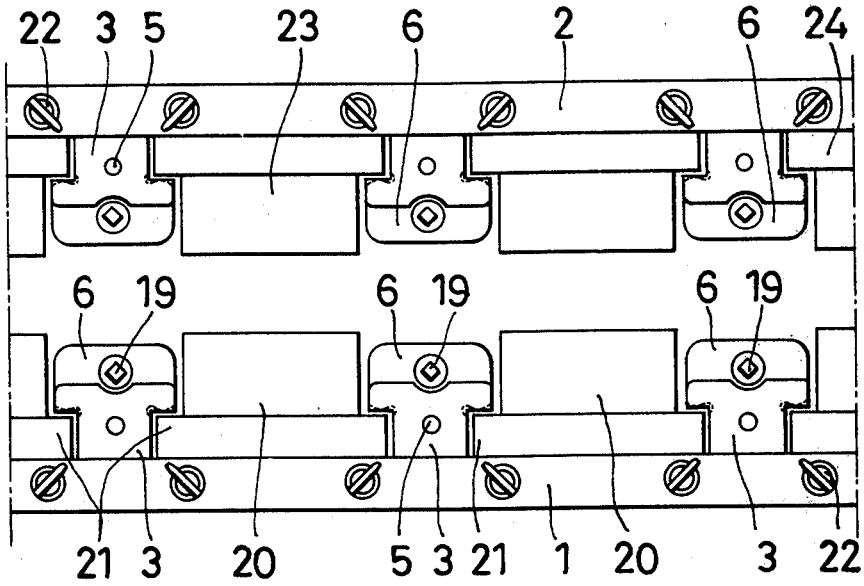
FIG. 1 is a front view of a device according to the present invention.

Referring to the drawings, a lower die mount 1 is secured to the bed of a press and an upper die mount 2 is secured to the underside of a ram of the press.

Figure 2:
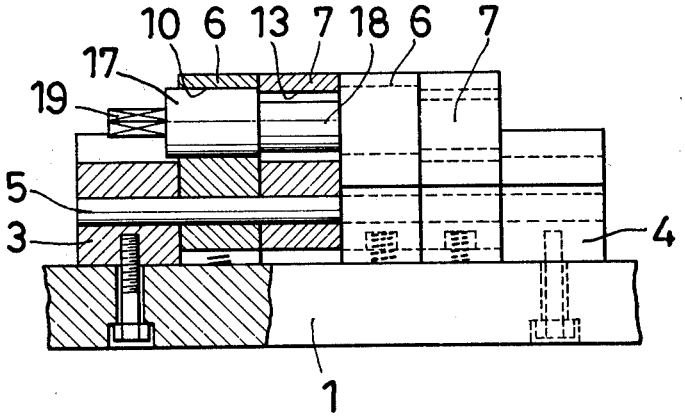
FIG. 2 is a sectional side elevation of a portion thereof.
Figure 3:
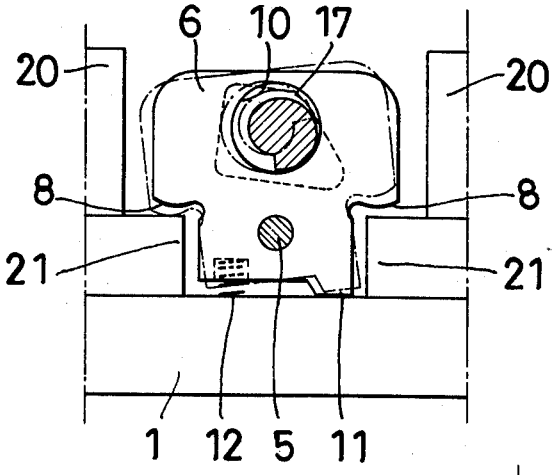
FIGS. 3 and 4 are enlarged front views of two types of clamps.

A pair of bearings 3 and 4 are bolted to the mount 1. A support shaft 5 has its front and rear ends fixed by the bearings 3 and 4 (FIG. 2). A plurality of clamps 6 and 7 are alternately mounted on the support shaft 5 so as to be slightly tiltable about the support shaft. (FIGS. 3 and 4) The clamps 6 and 7 have a shoulder 8 at their opposite sides.

The clamps 6 (FIG. 3) are formed with a round opening 10 above the hole for the support shaft 5 and with a projection 11 at their right side. They are provided with a spring 12 at their left side.

The other clamps 7 (FIG. 4) are formed with an opening 13 of a trapezoidal shape having an oblique surface 9 at its right side and formed with a projection 14 at their left side. They also are provided with a spring 15 at their right side.

A cam shaft 16 extends through the openings 10 of the clamps 6 and the openings 13 of the clamps 7. The openings 10 of the clamps 6 receive the enlarged portions 17 of the cam shaft and the openings 13 of the clamps 7 receive the spiral cams 18 thereof. The cam shaft 16 is formed with a square projection 19 or a square hole at its end for engagement with a handle for turning it. The enlarged portions 17 have a diameter equal to or larger than the maximum diameter of the spiral cam 18 so that the cam shaft 16 will pass easily through the clamps 6 and 7 in the assembly.

Figure 4:
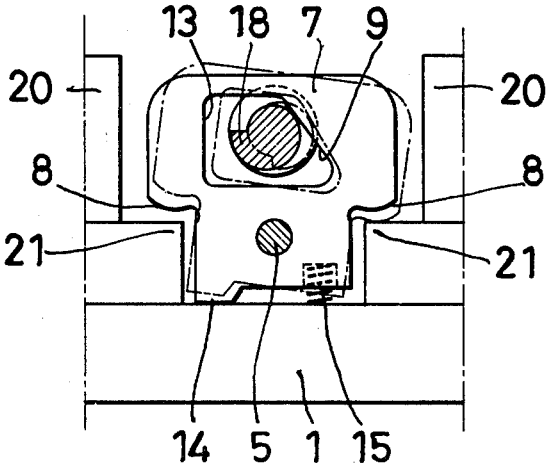
Figure 5:
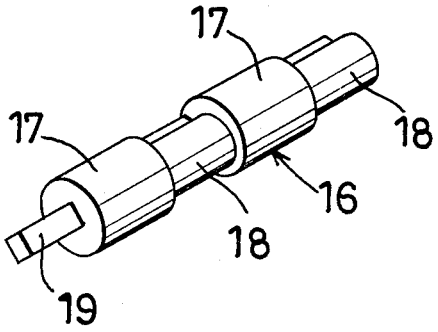
FIG. 5 is a perspective view of a camshaft.

When the spiral cam 18 is in such a position as shown with a solid line in FIG. 4, the spring 15 urges the clamp

7 counterclockwise and presses its projection 14 against the lower die mount 1. In this condition, the distance between the shoulder 8 on the left side of the clamp 7 and the surface of the lower die mount 1 is equal to the distance between the shoulder 8 on its right side and the surface of the lower die mount 1. Also, the spring 12 urges the clamp 6 clockwise and presses its projection 11 against the lower die mount 1. In this condition, the distance between the shoulder 8 on the left side of the clamp 6 and the surface of the lower die mount 1 is equal to the distance between the shoulder 8 on its right side and the surface of the lower die mount 1.

After the clamps 6 and 7 have been placed in this condition, dies 20 are mounted between the rows of the clamps 6 and 7 in such a manner that flanges 21 at both sides of each die 20 are placed right beneath the shoulders 8 of each clamp. Then, knobs 22 are turned to raise knock pins (not shown) to position the dies 20. A handle is fitted on the square projection 19 on the camshaft 16 and is turned so as to turn the camshaft 16 counterclockwise in FIG. 4.

As the camshaft 16 is turned, the oblique surface 9 of the opening is pushed to the right by the cam 18 so that the clamp 7 will be tilted rightwardly around the support shaft 5. As a result, the flange 21 of the die 20 mounted on the right side of the clamp 7 is pressed against the lower die mount 1 by the shoulder 8 on the right side of the clamp 7 as shown with a chain line in FIG. 4.

While the camshaft 16 is further turned counterclockwise, since the clamp 7 cannot tilt further to the right, the camshaft 16 itself is moved to the left by reaction force. Consequently, the clamp 6 begins to tilt leftwardly around the support shaft 5 so that the flange 21 of the die 20 mounted on the left side of the clamp 6 is pressed against the lower die mount 1 by the shoulder 8 on the left side of the clamp 6 as shown with a chain line in FIG. 3.

Now the dies 20 are secured to the surface of the lower die mount 1 by means of the clamps 6 and 7, and the press is ready for operation.

In order to remove the dies 20 from the press after pressing, the camshaft 16 is turned to an opposite direction so as to allow the clamps 6 and 7 to go back to their initial positions by the springs 12 and 15, respectively.

The above-described procedure holds good for the mounting of dies 23 against the under surface of the upper die mount 2 by means of another set of clamps 6 and 7.

The device according to the present invention has an advantage that all that one has to do to secure the dies 20 and 23 to the die mounts 1 and 2 is to turn the camshafts 16.

The device according to the present invention has another advantage that the dimensional inaccuracy in the thickness of the flanges 21 and 24 is allowable to a certain extent because the structure of the present invention has the effect of equalizing the force exerted by the clamps 6 and 7 to the dies.

The device according to the present invention has still another disadvantage that the dies 20 and 23 can be easily mounted on the surfaces of the die mounts because the clamps 6 and 7 arranged in a plurality of rows on the die mounts 1 and 2 serve as guides for the dies 20 and 23. The clamps 6 and 7 may be increased in number as desired.

While a preferred embodiment of the present invention has been disclosed, it is to be understood that it has been described by way of example only, various other modifications being obvious.

What we claim are:

1. A device for securing dies on a die mount of a press or the like, said device comprising:

a plurality of first clamps tiltably mounted on said die mount and formed with a shoulder at each side thereof, a projection at one side of the bottom, and a round opening, and provided with a spring at the other side of the bottom;

a plurality of second clamps tiltably mounted on said die mount and formed with a shoulder at each side thereof, a projection at one side of the bottom, and an opening of a trapezoidal shape, and provided with a spring at the other side of the bottom; and a camshaft extending through said first and second clamps and formed with a plurality of enlarged portions received in the openings of said first clamps and a plurality of spiral cams received in the opening of said second clamps;

said dies being placed between the rows of said first and second clamps and secured by said shoulders of said first and second clamps against the die mount when said camshaft is turned.

* * * * *